US005358234A

United States Patent [19]

Boriani et al.

[11] Patent Number: 5,358,234

[45] Date of Patent: Oct. 25, 1994

[54] CONVEYOR DEVICE FOR CHANGING THE DIRECTION OF SHEETS OF WRAPPING MATERIAL

[75] Inventors: Silvano Boriani; Antonio Gamberini, both of Bologna, Italy

[73] Assignee: G.D. Societa' Per Azioni, Bologna, Italy

[21] Appl. No.: 31,234

[22] Filed: Mar. 12, 1993

[30] Foreign Application Priority Data

Mar. 24, 1992 [IT] Italy ..... BO92 A 000103

[51] Int. Cl.[5] ..... B65H 5/00

[52] U.S. Cl. ..... 271/225; 271/276; 271/184; 271/197; 271/198; 198/689.1

[58] Field of Search ..... 271/225, 267, 275, 276, 271/184, 197, 198; 198/689.1, 471.1, 861.5

[56] References Cited

U.S. PATENT DOCUMENTS

| | | | |
|---|---|---|---|
| 3,473,800 | 10/1969 | Nystrand | 271/184 X |
| 3,599,967 | 8/1971 | Rapparlie | 271/276 X |
| 4,270,879 | 6/1981 | Kacirek | 271/197 X |
| 4,565,478 | 1/1986 | Ericsson | 271/225 X |
| 4,679,785 | 7/1987 | Helffer et al. . | |

*Primary Examiner*—Robert P. Olszewski
*Assistant Examiner*—Boris Milef
*Attorney, Agent, or Firm*—Ladas & Parry

[57] ABSTRACT

A conveyor device for sheets of wrapping material, whereby the sheets are transferred, from a first conveyor to a second conveyor forming an angle of other than zero, by a conveyor designed to swing between a forward position wherein the sheets are removed off the first conveyor, and a withdrawn position wherein the sheets are transferred to the second conveyor.

10 Claims, 1 Drawing Sheet

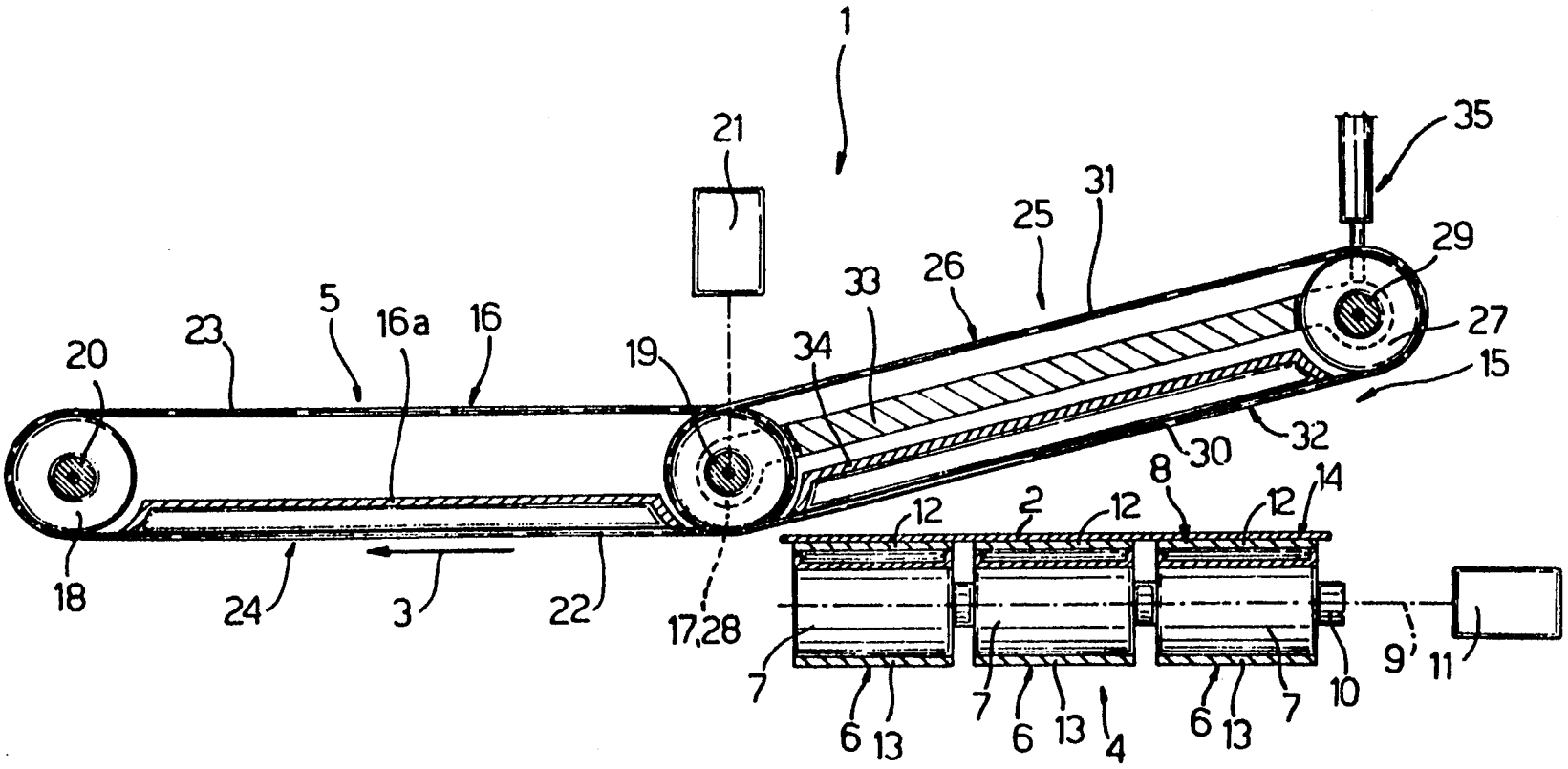
35
29
27
15
11
9'
10
14
12
7
13
6
32
30
8
4
31
25
2
26
33
1
34
21
17,28
19
22
16
16a
3
5
24
23
20
18

CONVEYOR DEVICE FOR CHANGING THE DIRECTION OF SHEETS OF WRAPPING MATERIAL

BACKGROUND OF THE INVENTION

The present invention relates to a conveyor device for sheets of wrapping material.

In particular, the present invention relates to a conveyor device for transferring sheets of wrapping material along a path having two portions forming an angle of other than zero.

In general, conveyor devices of the aforementioned type comprise a first and second linear conveyor forming an angle of other than zero, and the second of which, downstream from the first in the traveling direction of the sheets, overlaps an output portion of the first equal to at least the length of the sheets, and consists of a suction conveyor for removing the sheets by suction off the first conveyor.

A drawback of conveyor devices of the above type is that, when engaged by the second conveyor, the sheets tend to chafe transversely on the first as they are removed, thus resulting in damage in the case of relatively thin material.

SUMMARY OF THE INVENTION

It is an object of the present invention to provide a conveyor device for sheet material, designed to overcome the aforementioned drawback.

According to the present invention, there is provided a conveyor device for sheets of wrapping material, the device comprising two successive conveyors; and a transfer station interposed between the two conveyors; a first of the conveyors presenting an end portion adjacent to the other conveyor and extending through the transfer station; and the two conveyors forming, at the transfer station, a given angle of other than zero, and defining respective substantially coplanar transportation surfaces for said sheets; characterized by the fact that it also comprises a swing conveyor located at the transfer station and defining a transfer surface facing said end portion and tangent to the transportation surface of said other conveyor; actuating means being connected to the swing conveyor for moving the transfer surface to and from an operating position substantially coplanar with said end portion; and gripping means for said sheets being provided on at least one of said first and swing conveyors.

BRIEF DESCRIPTION OF THE DRAWING

The present invention will be described by way of example with reference to the accompanying drawing, which shows a schematic section and partial block diagram of a preferred non-limiting embodiment.

DETAILED DESCRIPTION OF THE INVENTION

Number 1 in the accompanying drawing indicates a conveyor device for successively transferring sheets 2, in which to wrap products (not shown), in direction 3 and along a path defined by two synchronized step conveyors 4 and 5 forming a given angle of other than zero and, in the example shown, substantially equal to 90°.

Conveyor 4 is preferably a suction conveyor, and is defined by a number of endless belts 6 arranged side by side and each looped about two guide rollers 7 (only one of which is shown). The rollers 7 at the output end portion 8 of conveyor 4 present a common axis 9, and are all fitted to a common shaft 10 coaxial with and rotated in steps about axis 9 by a motor 11. Rollers 7 define on belts 6 a top supply or transportation branch 12 and a bottom return branch 13; and branches 12, coplanar with one another, define a transportation surface 14 for feeding sheets 2 to a station 15 where they are transferred from conveyor 4 to conveyor 5.

Conveyor 5 is a suction conveyor, and is defined by a number of endless suction belts 16 (only one of which is shown) arranged side by side and each looped about two guide rollers 17 and 18 and a suction box **16*a*. Rollers 17 and 18 are fitted respectively to common shafts 19 and 20 perpendicular to axis 9, and shaft 19 is connected to the output of a motor 21 by which it is rotated in steps clockwise (in the accompanying drawing) and in time with the step rotation of shaft 10 by motor 11. Rollers 17 and 18 define on belts 16 a bottom supply or transportation branch 22 and a top return branch 23; and branches 22, coplanar with one another, define a transportation surface 24 extending from transfer station 15 and located over but substantially coplanar with surface 14**.

Conveyor 5 is positioned with shaft 19 adjacent to transfer station 15, through which extend both end portion 8 of conveyor 4 and a suction conveyor 25 for transferring sheets 2 from conveyor 4 to conveyor 5.

Conveyor 25 is defined by a number of endless suction belts 26 (only one of which is shown) arranged side by side and alternately with belts 16, and each looped about two guide rollers 27 and 28. Rollers 27 are all fitted to a common shaft 29 parallel to shafts 19 and 20, while rollers 28 are fitted, alternately with rollers 17, to shaft 19. Rollers 27 and 28 define on belts 26 a bottom supply or transportation branch 30 extending over and facing end portion 8 of conveyor 4, and a return branch 31; and branches 30, coplanar with one another, define a bottom transportation surface 32 over surface 14, facing end portion 8, and contiguous and tangent to transportation surface 24.

Shafts 19 and 29 are connected by a frame 33 supporting known suction boxes 34 arranged along transportation branch 30. Frame 33 is connected in rotary manner to shaft 19, and, by means of an actuating device 35 connected to frame 33 close to shaft 29, is swung between a raised idle position and a lowered operating position wherein branch 30 extends substantially contacting portion 8 of conveyor 4, and transportation surface 32 is positioned over and substantially coplanar with transportation surface 14.

Operation of device 1 will now be described commencing from the instant in which conveyors 4, 5 and 25 are all stationary, conveyor 25 is set to the raised position shown in the drawing, and a stationary sheet 2 is positioned on end portion 8 of conveyor 4 inside transfer station 15.

At this point, actuating device 35 is operated so as to swing conveyor 25 about shaft 19 and towards conveyor 4, and bring transportation surface 32 substantially into contact with sheet 2, which is drawn by suction on to transportation branch 30 of belts 26 before actuating device 35 is again operated for restoring conveyor 25, together with sheet 2, to the raised position, thus removing sheet 2 with no rubbing action off conveyor 4. As conveyor 25 is being raised, motors 11 and 21 are activated for feeding a further sheet 2 into station 15, and for feeding the transferred sheet 2 one step forward along the conveyor unit defined by conveyors 25 and 5, thus enabling device 1 to perform the next transfer cycle.

According to a variation not shown, the position of conveyors 25 and 5 in relation to conveyor 4 may be inverted so that conveyor 4 is located over conveyors 25 and 5; and, according to a further variation not shown, conveyor 25 may be connected to conveyor 4 as opposed to conveyor 5.

We claim:

1. A conveyor device (1) for sheets (2) of wrapping material, said device comprising two successive first and second conveyors (4, 5); a transfer station (15) interposed between said conveyors (4, 5); the first conveyor (4) having an end portion (8) adjacent to the second conveyor (5) and extending through the transfer station (15), the two conveyors (4, 5) forming, at the transfer station (15), a given angle of other than zero, and defining respective substantially coplanar first and second transportation surfaces (14, 24) for said sheets (2); a third conveyor (25) located at the transfer station (15) and defining a transfer surface (32) facing said end portion (8), the third conveyor (25) being a swing conveyor; actuating means (35) connected to the third conveyor (25) for pivoting the transfer surface (32) in relation to the second transportation surface (24) of said second conveyor (5) to and from an operating position substantially coplanar with said end portion (8); the transfer surface (32) and the second transportation surface (24) defining, at any time, a continuous surface; first drive means (11) for operating the first conveyor (4); second drive means (21) common to the second and third conveyors (5, 25) to drive the second and third conveyors (5, 25) at the same speed and substantially in time with the first conveyor (4); and gripping means (34) for holding said sheets (2) on at least one of said first and third conveyors (4, 25).

2. A device as claimed in claim 1, wherein at least one of said first and third conveyors (4, 25) is a suction conveyor.

3. A device as claimed in claim 1, wherein the second transportation surface (24) and the transfer surface (32) on the one hand and the first transportation surface on the other hand, face in opposite directions.

4. A device as claimed on claim 2, wherein the second transportation surface (24) and the transfer surface (32) on the one hand and the first transportation surface on the other hand, face in opposite directions.

5. A device as claimed in claim 2, wherein the second transportation surface (24) and the transfer surface (32) face downwards; the second and third conveyors (5, 25) being suction conveyors.

6. A device as claimed in claim 2, wherein said end portion (8) is at an output end of the first conveyor (4).

7. A device as claimed in claim 1, wherein said second drive means comprises first and second rollers (17, 28) aligned on a common shaft (19), said first rollers (17) drivingly engaging belt means of said second conveyor (15), said second rollers (28) drivingly engaging belt means of said third conveyor (25).

8. A device as claimed in claim 7, wherein said second drive means further comprises a drive motor (21) coupled to said shaft (19) for driving said first and second rollers in rotation together.

9. A device as claimed in claim 7, wherein said belt means of said second conveyor has a bottom branch (22) forming said transportation surface (24) and said belt means of said third conveyor has a bottom branch (30) forming said transfer surface (32), said bottom branches of said second and third conveyors forming said continuous surface around said first and second rollers.

10. A device as claimed in claim 9, wherein said first and second conveyors are driven to convey said sheets at right angles to one another.

* * * * *

UNITED STATES PATENT AND TRADEMARK OFFICE

CERTIFICATE OF CORRECTION

PATENT NO. : 5,358,234

DATED : October 25, 1994

INVENTOR(S) : Silvano BORIANI, et al.

It is certified that error appears in the above-indentified patent and that said Letters Patent is hereby corrected as shown below:

On title page, item 73, "D." should be -- D --.

Signed and Sealed this

Sixth Day of May, 1997

*Attest:*

*Attesting Officer*

BRUCE LEHMAN

*Commissioner of Patents and Trademarks*